US005820399A

United States Patent [19]

Shirouzu et al.

[11] Patent Number: 5,820,399

[45] Date of Patent: Oct. 13, 1998

[54] CONNECTOR FITTING CONSTRUCTION

[75] Inventors: Kouichi Shirouzu, Aichi; Shigemitsu Inaba, Shizuoka; Satoshi Yamada, Shizuoka; Etsuro Suzuki, Shizuoka; Toshifumi Matsuura, Shizuoka, all of Japan

[73] Assignees: Yazaki Corporation, Tokyo; Toyota Jidosha Kabushiki Kaisha, Aichi, both of Japan

[21] Appl. No.: 901,780

[22] Filed: Jul. 28, 1997

[30] Foreign Application Priority Data

Aug. 6, 1996 [JP] Japan ..... 8-207288

[51] Int. Cl.[6] ..... H01R 13/627

[52] U.S. Cl. ..... 439/352

[58] Field of Search ..... 439/350–352

[56] References Cited

U.S. PATENT DOCUMENTS 4,915,648 4/1990 Takase et al. ..... 439/490
5,688,142 11/1997 Dietz et al. ..... 439/352

FOREIGN PATENT DOCUMENTS 5-81967 11/1993 Japan ..... H01R 13/639
6-89759 3/1994 Japan ..... H01R 13/703

*Primary Examiner*—Hien Vu
*Attorney, Agent, or Firm*—Sughrue, Mion, Zinn, Macpeak & Seas, PLLC

[57] ABSTRACT

A connector fitting construction in which a half-fitted condition is positively prevented when fitting a pair of male and female connectors together, and the fitting operation and a fitting release operation can be effected easily, and a connector housing can be formed into a small size. In this connector fitting construction, the male connector includes a connector housing, and an exclusive-use housing forming a slider receiving portion for receiving a slider therein. Guide grooves for respectively guiding opposite side portions of a body of the slider are formed respectively in opposite side portions of the exclusive-use housing. A lock arm, provided at a central portion of the exclusive-use housing, includes a lock beak having a slanting surface, and a housing lock formed on a lower surface thereof at a front end thereof, and side spaces are provided respectively on opposite sides of the lock arm. The slider has a slider arm provided in the slider body, the slider arm having a pair of abutment projections. The female connector includes a pair of stopper projections, which are formed on a housing, and abut respectively against the abutment projections when the two connectors are fitted together, a slanting projection having a slanting surface, and an engagement groove.

8 Claims, 14 Drawing Sheets

CONNECTOR FITTING CONSTRUCTION

BACKGROUND OF THE INVENTION

1. Field of the Invention

This invention relates to a connector fitting construction in which a half-fitted condition is positively prevented by a resilient force of a resilient member mounted in a housing of at least one of a pair of male and female connectors to be fitted together, and the connector, fitted on the mating connector, is positively locked.

2. Background

Usually, many electronic equipments for effecting various controls are mounted on a vehicle such as an automobile, and therefore, naturally, many wire harnesses and flat cables have been used. Automobiles and the like are used in a severe environment in which vibrations and submergence are encountered, and therefore there have been used various types of female and male connectors which have a waterproof function, and can be easily connected to a wire harness or the like in view of the efficiency of an assembling operation and the efficiency of the maintenance.

Various half-fitting prevention connectors, in which a condition of fitting between female and male connectors, can be detected, have been used, and one such example is disclosed in Unexamined Japanese Utility Model Publication No. Hei. 5-81967.

One example of conventional half-fitting prevention connector will now be described with reference to FIGS. 14 and 15. A pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having a front side which is opened, and a guide plate 55 for guiding the fitting of the socket-type connector 51 is mounted centrally of the height within the housing 54, and divides the interior of the housing 54 into an upper portion and a lower portion. Within the housing 54, the pin contacts 52 extend from a rear portion toward the front side of this housing. A notch is formed in a middle portion of a top plate 54*b*, and an engagement piece portion 56 is formed integrally with the top plate 54*b* so as to extend frontwardly, and is disposed in this notch. A distal end of the engagement piece portion 56 is receded from the front edges of the top plate 54*b*, and is cantilevered to have a flexibility. An engagement projection 56*a* is formed on the inner side of the distal end of the engagement piece portion 56.

The socket-type connector 51 includes a box-shaped housing 57 to be fitted into the opening in the housing 54 of the pin-type connector 50. Pin holes 58 for respectively receiving the pin contacts 52, and a slot 59 for receiving the guide plate 55 are provided in the front side of the housing 57.

A movable cover 60 is fitted on the housing 57 for movement back and forth, and covers the housing 57 except front and rear end portions thereof. An opening 61, for receiving the pin-type connector 50, is formed in the front side of the movable cover 60. The opening 61 has such a size as to receive opposite side plates 54*a*, the top plate 54*b* and a bottom plate 54*c* of the housing 54.

A pair of opposed spring receiving portions (not shown) are formed respectively at opposite side portions of the movable cover 60 and hence at opposite side portions of the housing 57, and springs 64 are received respectively in the spring receiving portions, each of the springs 64 extending in the forward-backward direction. The movable cover 60 is normally urged forward by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* of the engagement piece portion 56 is engaged in the engagement groove 67 when the two connectors are completely connected together. The engagement groove 67 is normally concealed by the movable cover 60, and appears when the movable cover 60 is moved.

When the two connectors 50 and 51 are fitted together, the pin contacts 52 contact the socket contacts 53, respectively, and the engagement projection 56*a* is engaged in the engagement groove 67, as shown in FIG. 15. In this fitted condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a half-fitted condition is encountered, the distal end of the engagement piece portion 56 abuts against the edge of the opening in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together at all.

In the connectors 50 and 51 disclosed in the above Unexamined Japanese Utility Model Publication No. Hei. 5-81967, however, the half-fitted condition can be prevented, but when trying to fit the two connectors 50 and 51 together while holding the opposite side surfaces of the movable cover 60 with the hand, the movable cover 60 can not be moved, so that the fitting operation can not be effected.

The spring receiving portions are provided respectively at the opposite side portions of the housing 57 and at the opposite side portions of the housing 57, and besides the movable cover 60 is mounted on the outer periphery of the housing 57, so that the socket-type connector 51 has an increased size, and therefore this construction is not suitable for a small-size connector for connecting a few female and male contacts together.

SUMMARY OF THE INVENTION

With the above problems in view, it is an object of this invention to provide a connector fitting construction in which a half-fitted condition is positively prevented when fitting a pair of male and female connectors together, and the fitting operation and a fitting release operation can be effected easily, and a connector housing can be formed into a small size.

The above object of the present invention has been achieved by a connector fitting construction recited in the following paragraphs (1) to (5):

(1) A connector fitting construction, includes a pair of male and female connectors can be fitted and connected together, a half-fitted condition of the two connectors is prevented by a resilient force of a resilient member mounted in a housing of one of the two connectors, and a slide lock member is slidably supported in the housing, and cooperates with the resilient member, when fitting the one connector relative to the mating connector, to flex an elastic member, provided on the housing, to retain the elastic member on a mating housing; in which a receiving portion, receiving the slide lock member therein, is formed by an exclusive-use housing other than a connector housing having terminal receiving chambers; and side spaces are provided in the receiving portion, and are disposed respectively on opposite sides of the elastic member; and abutment projections, formed respectively on opposite side portions of a lower surface of an elastic arm formed on the slide lock member, are disposed respectively in the side spaces.

(2) A connector fitting construction according to the above paragraph (1), in which the elastic member is a lock arm of the cantilever-type having a lock beak formed on an upper surface thereof, and the lock beak has a slanting surface, and an engagement projection for being retained on the mating housing is formed on a lower surface of the lock arm at a front end thereof.

(3) A connector fitting construction according to the above paragraph (1), in which the slide lock member has the elastic arm of the cantilever type provided at a generally central portion of a body of the slide lock member, the elastic arm having the pair of abutment projections formed respectively on the opposite side portions of the lower surface thereof at a front end thereof, and the slide lock member further includes a press portion which is formed on an upper surface thereof at a rear end thereof, and is operated when releasing the fitted condition, a slide groove formed in the elastic arm and the press portion, and spring retaining portions which are formed respectively at opposite side portions of the rear end thereof, and respectively retain compression springs serving as the resilient member.

(4) A connector fitting construction according to the above paragraph (1), paragraph (2) or paragraph (3), in which guide grooves for respectively guiding the opposite side portions of the lock member body are formed respectively in opposite side portions of the exclusive-use housing, and spring receiving portions of a tubular shape are formed respectively at rear ends of the guide grooves.

(5) A connector fitting construction according to any one of the above paragraphs (1) to (4), in which the housing of the mating connector includes a pair of stopper projections for abutting respectively against the abutment projections of the slide lock member when fitting the two connectors together, a slanting projection which is formed between the stopper projections, and has a slanting surface for flexing the elastic member, and an engagement groove formed adjacent to a rear end of the slanting projection for engagement with the engagement projection.

In the connector fitting construction recited in the above paragraphs (1) to (5), when the slide lock member, holding the compression springs, is pushed into the receiving portion from the front side of the male connector before the male and female connectors are fitted together, the lock member body moves rearward along the guide grooves provided in the receiving portion. At this time, the abutment projections, formed respectively at the opposite side portions of the lower surface of the slider arm, are disposed respectively in the side spaces provided respectively on the opposite sides of the lock arm. The compression springs are received respectively in the spring receiving portions, and the lock beak on the lock arm is fitted in the slide groove in the slide lock member, so that the slide lock member is slidably mounted on the male connector.

When the male and female connectors begin to be fitted together, the stopper projections of the female connector are fitted respectively into the side spaces provided respectively on the opposite sides of the lock arm of the male connector, and when the fitting operation further proceeds, the stopper projections abut respectively against the abutment projections of the slide lock member. When the fitting operation further proceeds, the slide lock member is pushed rearward against the bias of the compression springs.

If the pushing operation is stopped in this half-fitted condition, the male and female connectors are moved away from each other in a disengaging direction (opposite to the fitting direction) by the resilient force (bias) of the compression springs, and therefore the half-fitted condition can be easily detected.

Then, when the fitting operation further proceeds, the engagement projection at the front end of the lock arm abuts against the slanting projection on the female connector, and the elastic arm of the slide lock member is flexed upwardly by the lock beak, so that the abutment of the stopper projections against the abutment projections of the slide lock member is released.

As a result, the elastic arm slides over the stopper projections, and the engagement projection at the front end of the lock arm slides over the slanting projection, so that the slide lock member is returned to its initial position by the resilience force (bias) of the compression springs. At this time, the lower surface of the front end of the slide lock member abuts against the upper side of the engagement projection formed at the front end of the lock arm, so that the lock arm is locked against displacement. The engagement projection on the lock arm is retainingly engaged in the engagement groove in the female connector, so that the male and female connectors are completely fitted together, and the female contacts are completely connected to the male contacts, respectively.

This completely-fitted condition can be detected through a sense of touch obtained when the engagement projection of the lock arm slides over the slanting projection, and also can be easily detected by confirming the position of the returned slide lock member with the eyes.

Therefore, in the half-fitted condition, the male and female connectors can be moved away from each other by the resilient force of the compression springs, and the fitted condition can be easily detected through the sense of touch, obtained during the fitting operation, and also through the position of the slide lock member.

The male and female connectors can be fitted together while holding the side wall of the male housing with the hand, and the fitting operation can be easily carried out.

Since the elastic arm is provided in the body of the slide lock member, the slide lock member can be formed into a small size. And besides, the side spaces are provided respectively on the opposite sides of the lock arm, and the abutment projections of the slider lock member are disposed respectively in these side spaces, and therefore at least the male housing, having the slide lock member mounted thereon, can be formed into a small size.

For releasing the above completely-fitted condition, the male connector is withdrawn in a direction of compression of the compression springs while depressing the press portion of the slide lock member by the finger, so that the abutment of the upper side of the engagement projection, formed at the front end of the lock arm, against the lower surface of the front end of the slide lock member is released, and the free end portion of the lock arm can be displaced. Then, when the slide lock member is pulled back, the elastic arm of the slide lock member slides over the slanting surface of the lock beak, and is flexed upwardly. Therefore, by withdrawing the female connector body in the disengaging direction, the engagement projection (formed at the front end of the lock arm), retainingly engaged in the engagement groove, is flexed or displaced upwardly, thus releasing the retained condition, so that the female connector can be easily disengaged from the male connector.

DETAILED DESCRIPTION OF THE PREFERRED EMBODIMENT

One preferred embodiment of a connector fitting construction of the present invention will now be described in detail with reference to FIGS. 1 to 13.

Figure 1:
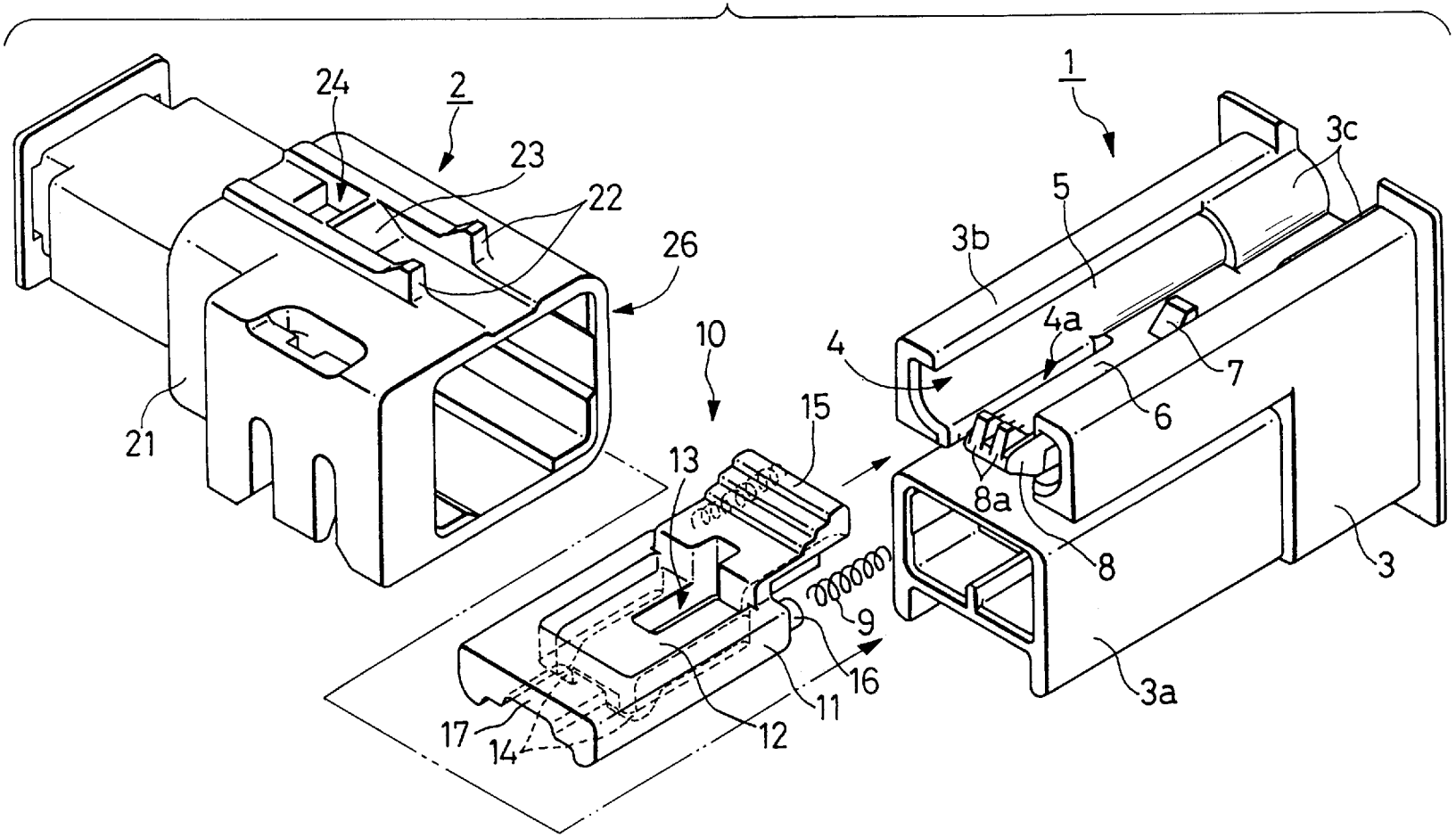
FIG. 1 is an exploded, perspective view showing a preferred embodiment of a connector fitting construction of the invention.

As shown in FIG. 1, the connector fitting construction of this embodiment comprises a pair of male and female connectors 1 and 2 of the non-waterproof type, and a housing 3 of the male connector 1 includes a connector housing 3*a*, which has terminal receiving chambers (each in the form of a through hole) for respectively receiving a predetermined number of socket contacts, and a terminal insertion hole open to the front side, and an exclusive-use housing 3*b* formed above the connector housing 3*a*, and a slider (slide lock member) 10 is slidably mounted in the exclusive-use housing 3*b*.

The exclusive-use housing 3*b* is provided to form a slider receiving portion 4 for receiving the slider 10, and is open upwardly along a fitting direction. A pair of guide grooves 5 for respectively guiding opposite side portions of a body of the slider 10 are formed respectively in opposite side portions of the exclusive-use housing 3*b*, and spring receiving portions 3*c* of a tubular shape are formed respectively at rear ends of the guide grooves 5.

A lock arm (elastic member) 6 of the cantilever type is formed integrally on a central portion of the exclusive-use housing 3*b*, and extends in the fitting direction. A lock beak 7, having a slanting surface, is formed on an upper surface of the lock arm 6, and a housing lock (engagement projection) 8 for retaining engagement with a female housing 21 (described later) is formed on a lower surface of the lock arm 6 at a distal end thereof. Displacement prevention projections 8*a* for preventing displacement of the lock arm 6 are formed on that portion of the upper surface of the lock arm 6 facing away from the housing lock 8.

Side spaces 4*a* for respectively receiving abutment projections 14 of a slider arm 12 (described later) are provided respectively on opposite sides of the lock arm 6.

The elastic slider arm 12 of the cantilever type is formed at a generally central portion of the slider body 11 of the slider 10, and this slider arm 12 has the pair of abutment projections 14 formed respectively at opposite side portions of a lower surface thereof at a front end thereof. The slider arm 12 further includes a press portion 15, which is formed on an upper surface thereof at a rear end thereof, and is operated when releasing the fitted condition, a slide groove (through hole) 13 formed in the slider arm 12 and the press portion 15, and spring retaining portions 16 which are formed respectively at opposite side portions of the rear end thereof, and retain compression springs 9, respectively. A displacement prevention portion 17, for preventing displacement of the lock arm 6, is formed at the front end of the slider body 11.

The female connector 2 includes terminal receiving chambers having through holes for respectively receiving a predetermined number of pin contacts, and a housing insertion hole 26 open to the front side. A pair of stopper projections 22 for abutting respectively against the abutment projections 14 of the slider 10 when fitting the connectors together are formed on one side surface of the housing 21, and a slanting projection 23, having a slanting surface for flexing the lock arm 6, is formed between the stopper projections 22 and 22, and an engagement groove 24 for engagement with the housing lock (engagement projection) 8 is formed adjacent to the rear end of the slanting projection 23.

A procedure of fitting the above male and female connectors together will be described.

First, the slider 10 is attached to the male connector 1 as shown in FIG. 1. More specifically, when the slider 10, having the compression springs 9 retained respectively on the spring retaining portions 16, is pushed into the slider receiving portion 4 from the front side of the male connector 1, the slider body 11 moves rearwardly along the guide grooves 5. At this time, the abutment projections 14, formed respectively at the opposite side portions of the lower surface of the slider arm 12, are disposed respectively in the side spaces 4*a* provided respectively on the opposite sides of the lock arm 6. The compression springs 9 are received respectively in the spring receiving portions 3*c*, and the lock beak 7 on the lock arm 6 is fitted in the slide groove 13 in the slider 10. Thus, the slider 10 is slidably mounted on the male connector 1.

Figure 2:
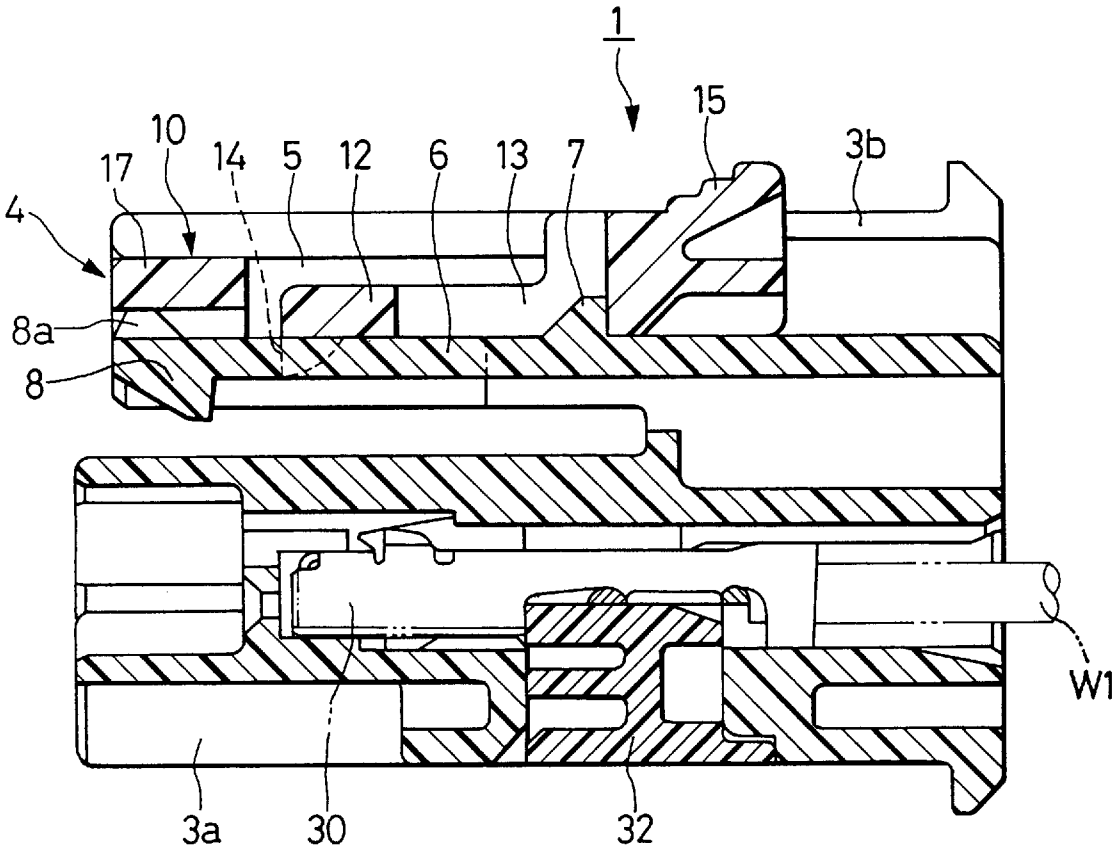
FIG. 2 is a vertical cross-sectional view of a male connector in FIG. 1.
Figure 3:
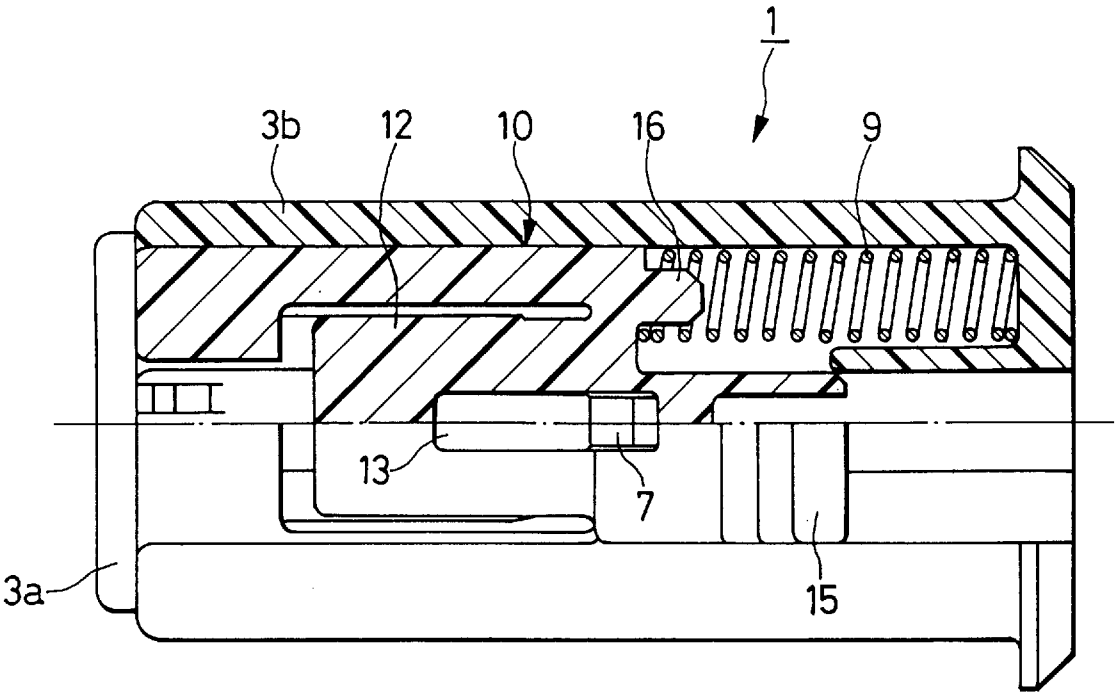
FIG. 3 is a horizontal cross-sectional view of the male connector of FIG. 2.
Figure 4:
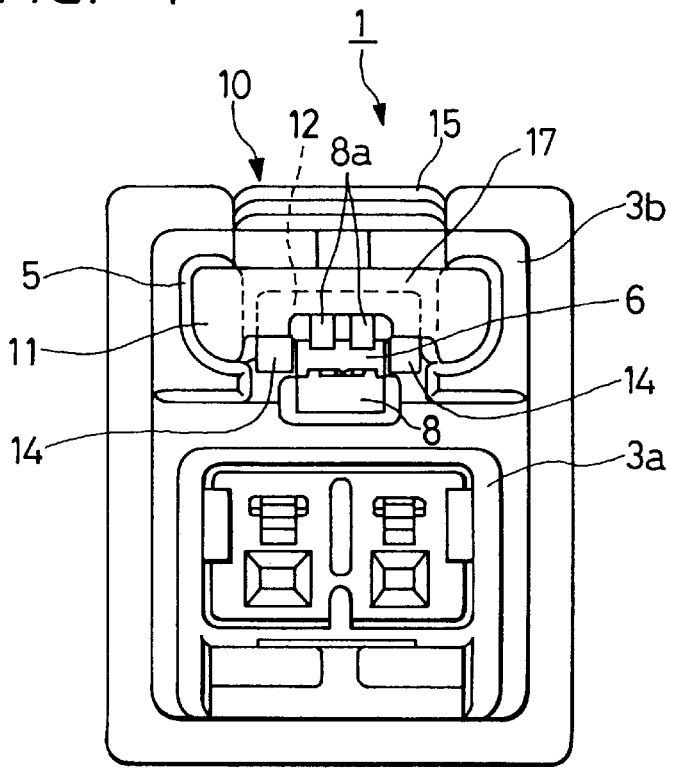
FIG. 4 is a front-elevational view of the male connector in FIG. 1.

In the above condition shown in FIGS. 2 to 4, the slider 10 is urged forwardly by the resilient force of the compression springs 9. The front end of the press portion 15 is retained by the lock beak 7 received in the slide groove 13, and also the displacement prevention projections 8*a*, formed at the front end of the lock arm 6, abut against the displacement prevention portion 17 formed at the lower surface of the front end of the slider 10, so that the lock arm 6 is prevented from being displaced upward.

Then, as shown in FIG. 2, each of the socket contacts 30, connected to one end of a wire W1, is inserted into the housing 3 from the rear side thereof, and is retained by a housing lance provided within the terminal receiving chamber. Further, a holder 32 for double retaining purposes is attached to the housing 3.

Figure 6:
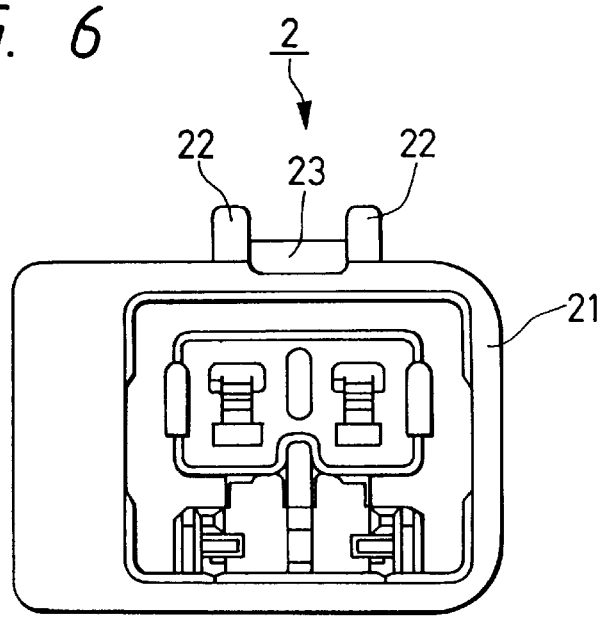
FIG. 6 is a front-elevational view of the female connector in FIG. 5.
Figure 5:
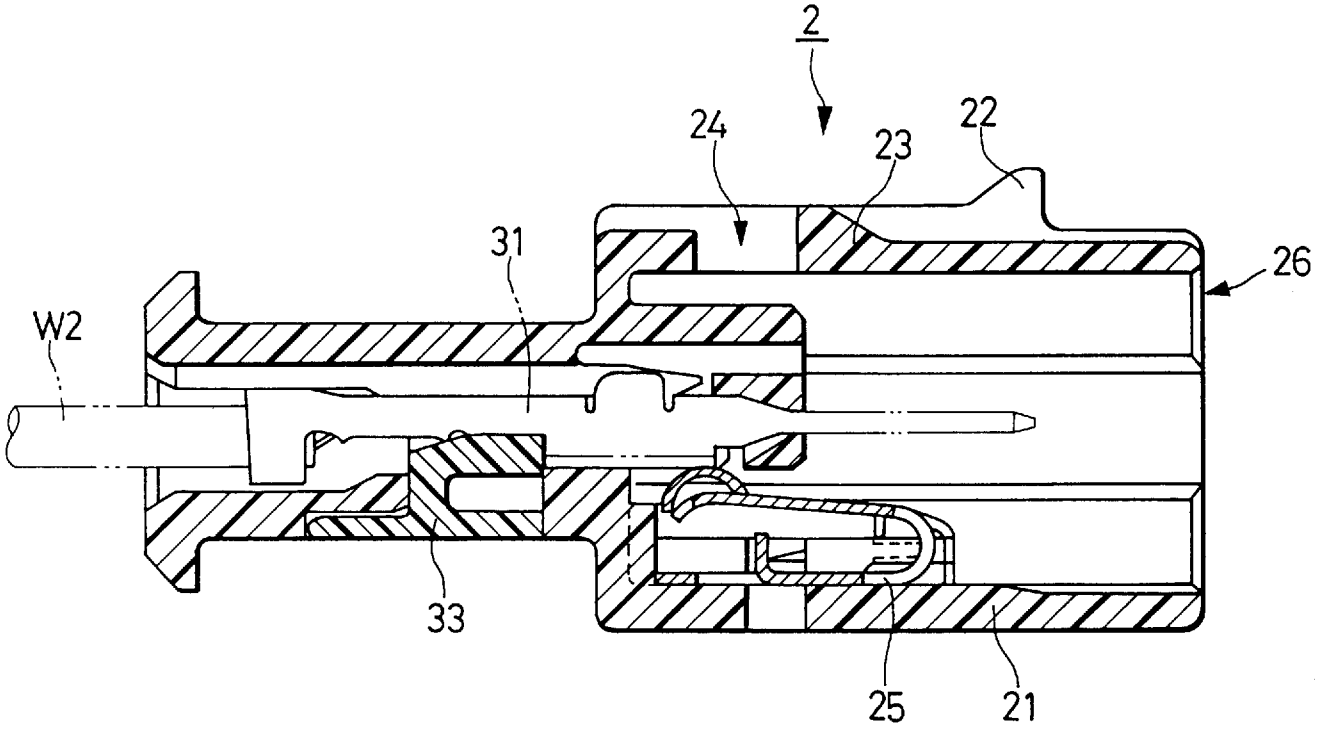
FIG. 5 is a vertical cross-sectional view of a female connector in FIG. 1.

As shown in FIGS. 5 and 6, each of the pin contacts 31, connected to one end of a wire W2, is inserted into the housing 21 of the female connector 2 from the rear side thereof, and is retained by a housing lance provided within the terminal receiving chamber. Further, a holder 33 for double retaining purposes is attached to the housing 21. A short-circuiting spring 25 for short-circuiting the specified pin contacts together or for breaking a short-circuited condition, is mounted in a predetermined position within the housing 21.

Next, the operation of fitting the male and female connectors 1 and 2 will be described.

Figure 7:
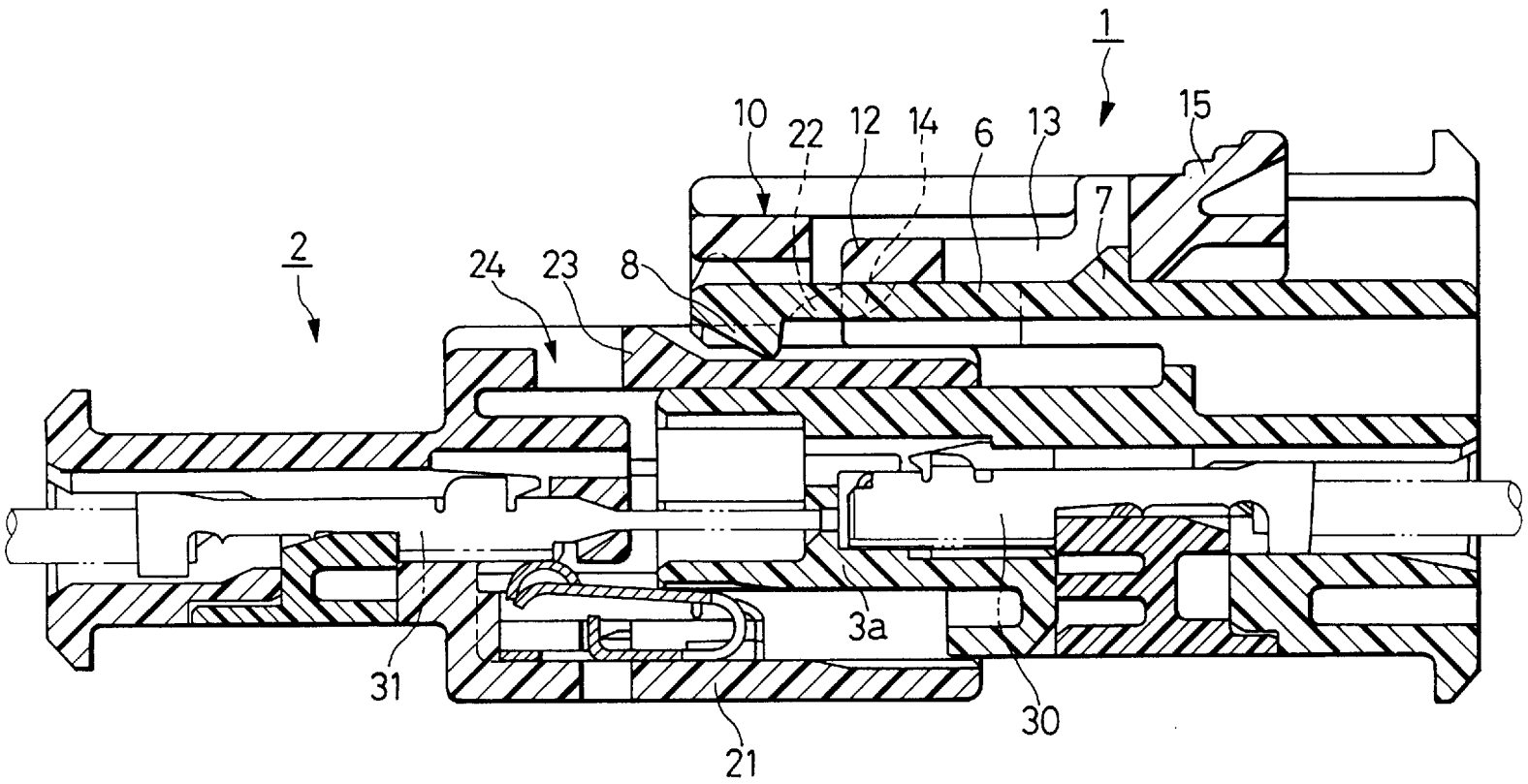
FIG. 7 is a view showing an initial fitted condition of the male and female connectors.

When the male and female connectors begin to be fitted together as shown in FIG. 7, the stopper projections 22 of the female connector 2 are fitted respectively into the side spaces 4*a* (see FIG. 1) provided respectively on the opposite sides of the lock arm 6 of the male connector 1, and the stopper projections 22 abut respectively against the abutment projections 14 of the slider 10. At this stage, the pin contacts 31 in the female connector 2 have not yet been inserted respectively in the socket contacts 30 in the male connector 1.

Figure 8:
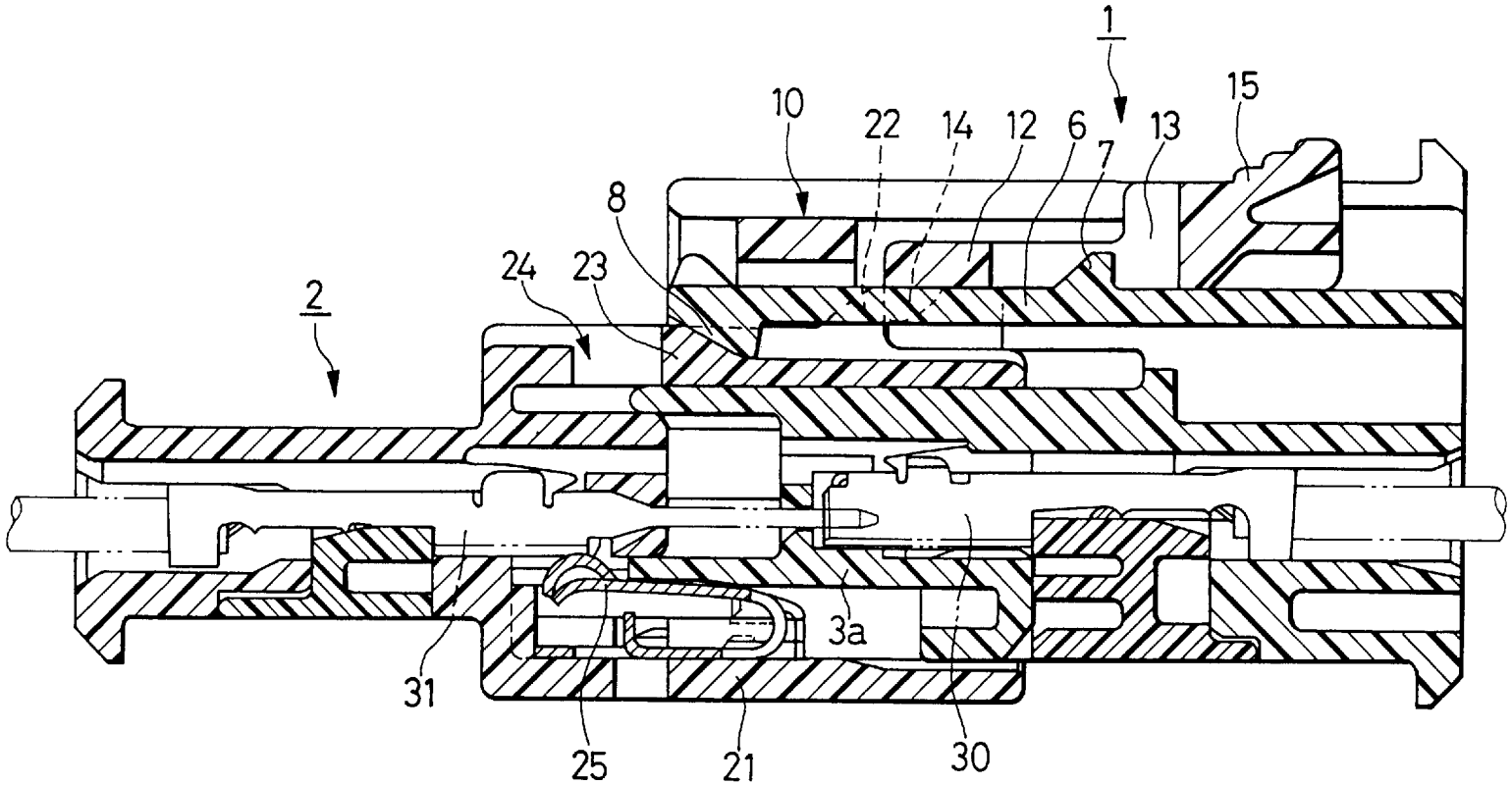
FIG. 8 is a view showing a condition during the fitting operation of the male and female connectors.

Then, when the fitting operation further proceeds as shown in FIG. 8, the slider 10 is pushed rearward against the bias of the compression springs 9, and the housing lock 8 at the front end of the lock arm 6 abuts against the slanting projection 23 of the female connector 2. At this stage, the pin contacts 31 are inserted respectively into the socket contacts 30, but are not completely electrically connected thereto.

If the pushing operation is stopped under this half-fitted condition, the male and female connectors 1 and 2 are moved away from each other in a disengaging direction (opposite to the fitting direction) by the resilient force of the compression springs 9, and therefore the half-fitted condition can be easily detected.

Figure 9:
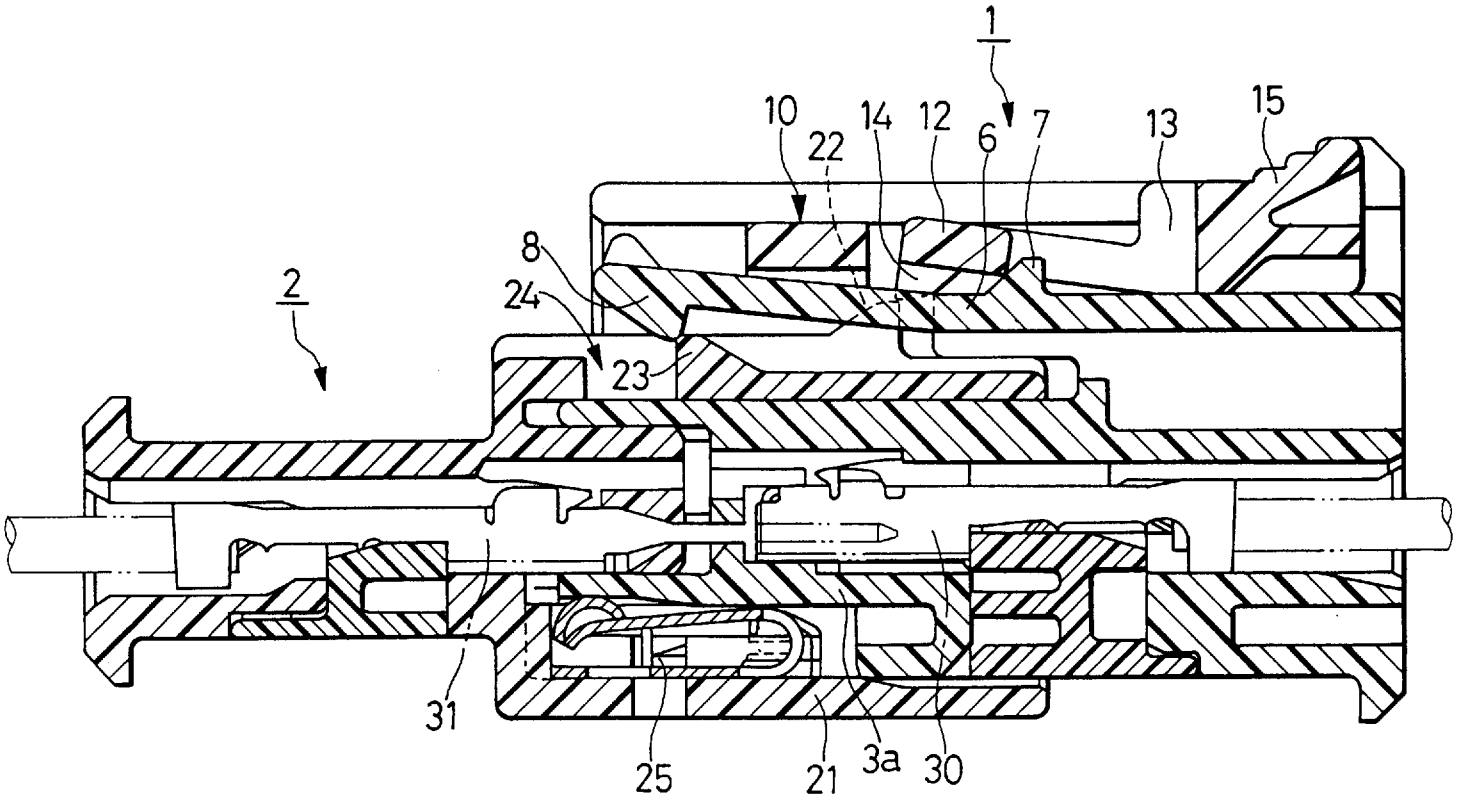
FIG. 9 is a view showing a condition in which the fitted condition of FIG. 8 has further proceeded.

Then, when the fitting operation further proceeds as shown in FIG. 9, the slider arm 12 of the slider 10 is flexed upwardly by the lock beak 7, so that the abutment of the stopper projections 22 against the abutment projections 14 of the slider 10 is released. Then, the housing lock 8 at the front end of the lock arm 6 slides over the slanting projection 23, and is about to be engaged in the engagement groove 24. The front end of the connector housing 3*a* of the male connector 1 causes the short-circuiting spring 25 to be brought out of short-circuiting relation to the pin contact 31 in the female connector 2.

Figure 10:
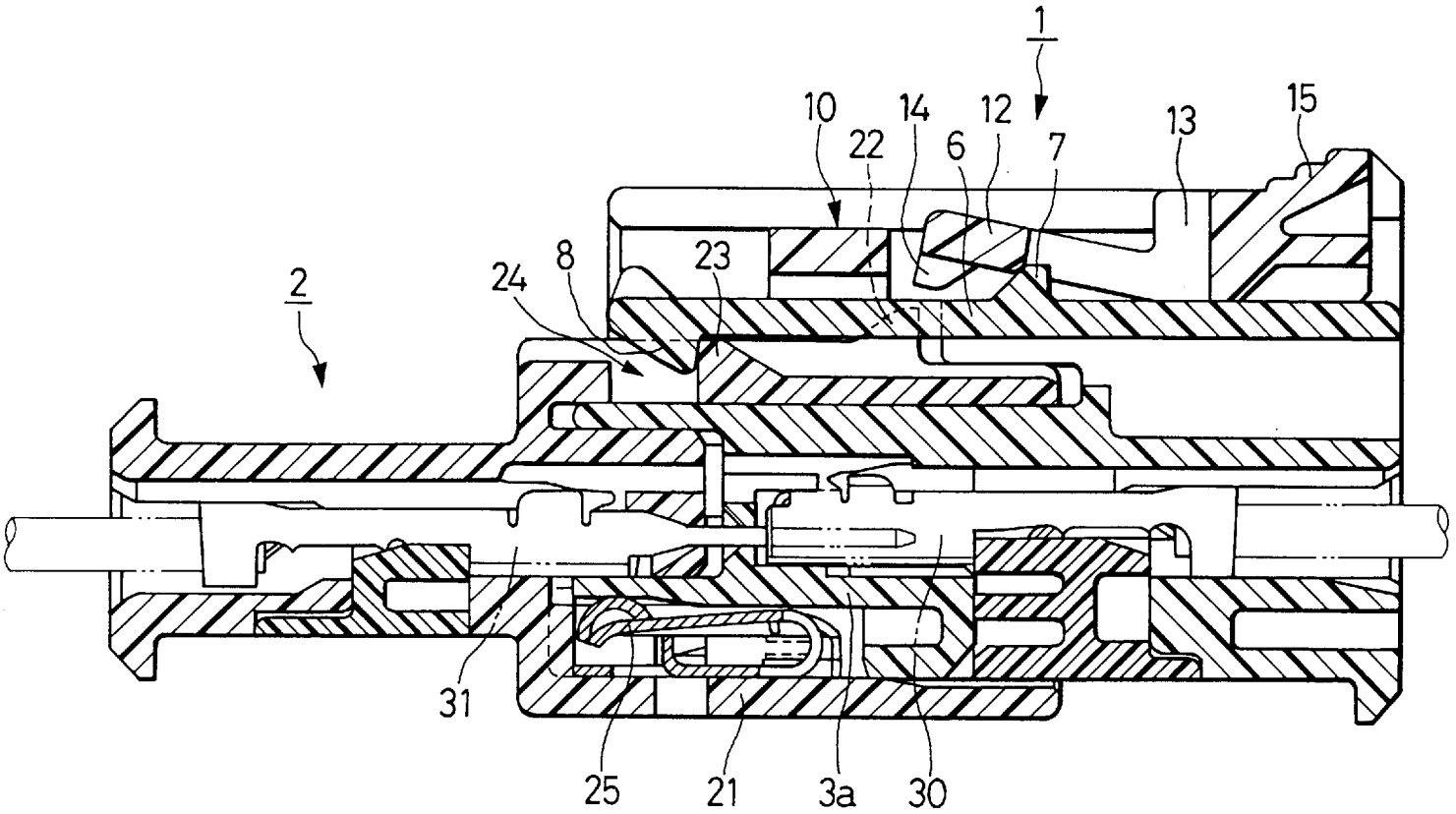
FIG. 10 is a view showing a condition in which the fitting operation of FIG. 9 is completed.

Then, as shown in FIG. 10, because of the resilient force of the compression springs 9, the slider arm 12 slides over the stopper projections 22, and the housing lock 8 becomes engaged in the engagement groove 24.

Figure 11:
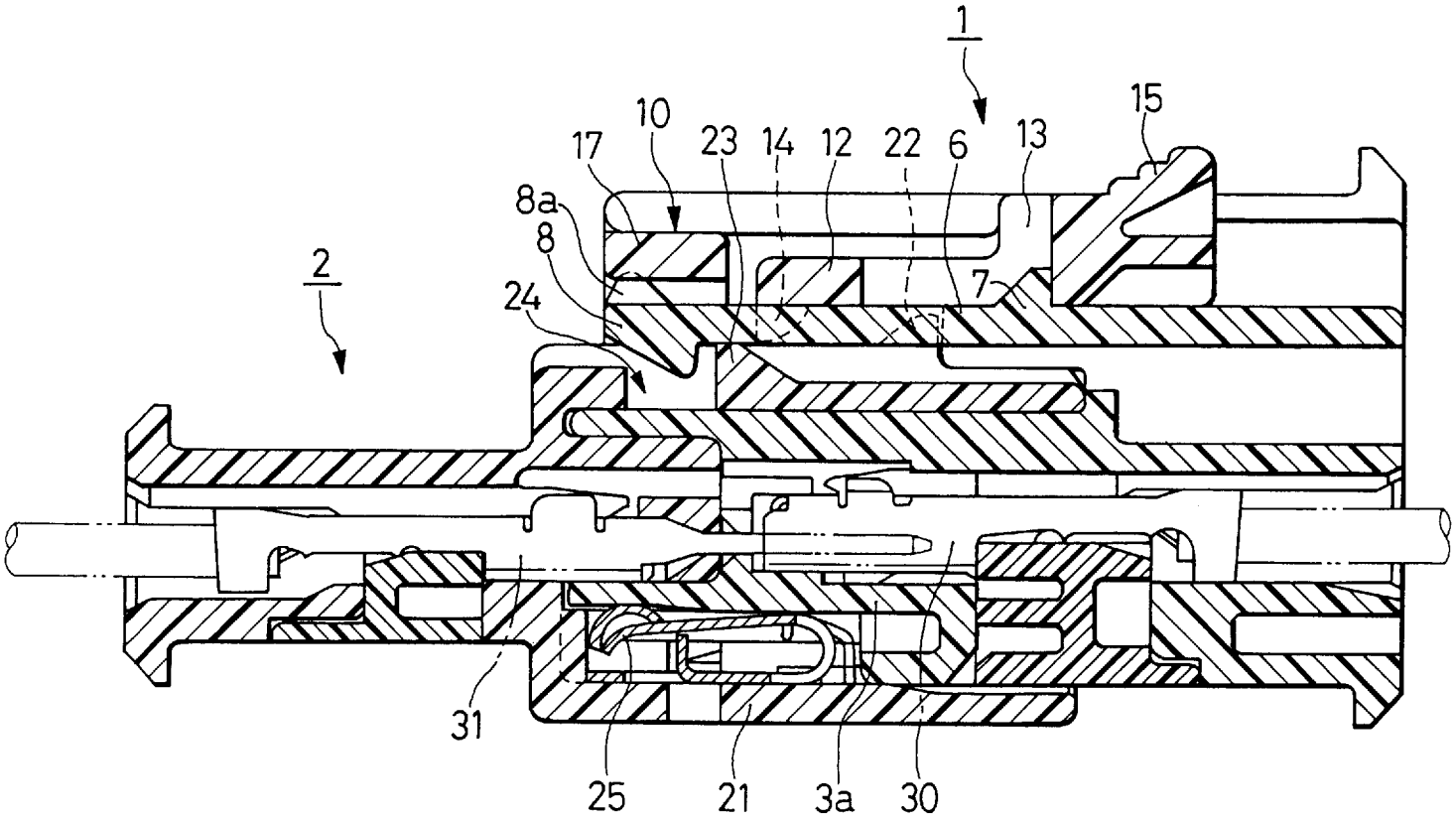
FIG. 11 is a view showing a condition in which the fitting of the male and female connectors is completed.

Then, as shown in FIG. 11, the slider 10 is returned to its initial position by the resilient force of the compression springs 9. At this time, the displacement prevention portion 17 of the slider 10 abuts against the displacement prevention projections 8*a* of the lock arm 6, thereby locking the lock arm 6. Thus, the male and female connectors are completely fitted together, and the contacts 30 are completely connected to the contacts 31, respectively.

This completely-fitted condition can be detected through a sense of touch obtained when the housing lock 8 of the lock arm 6 slides over the slanting projection 23, and also can be easily detected by confirming the position of the returned slider 10 with the eyes.

Figure 12:
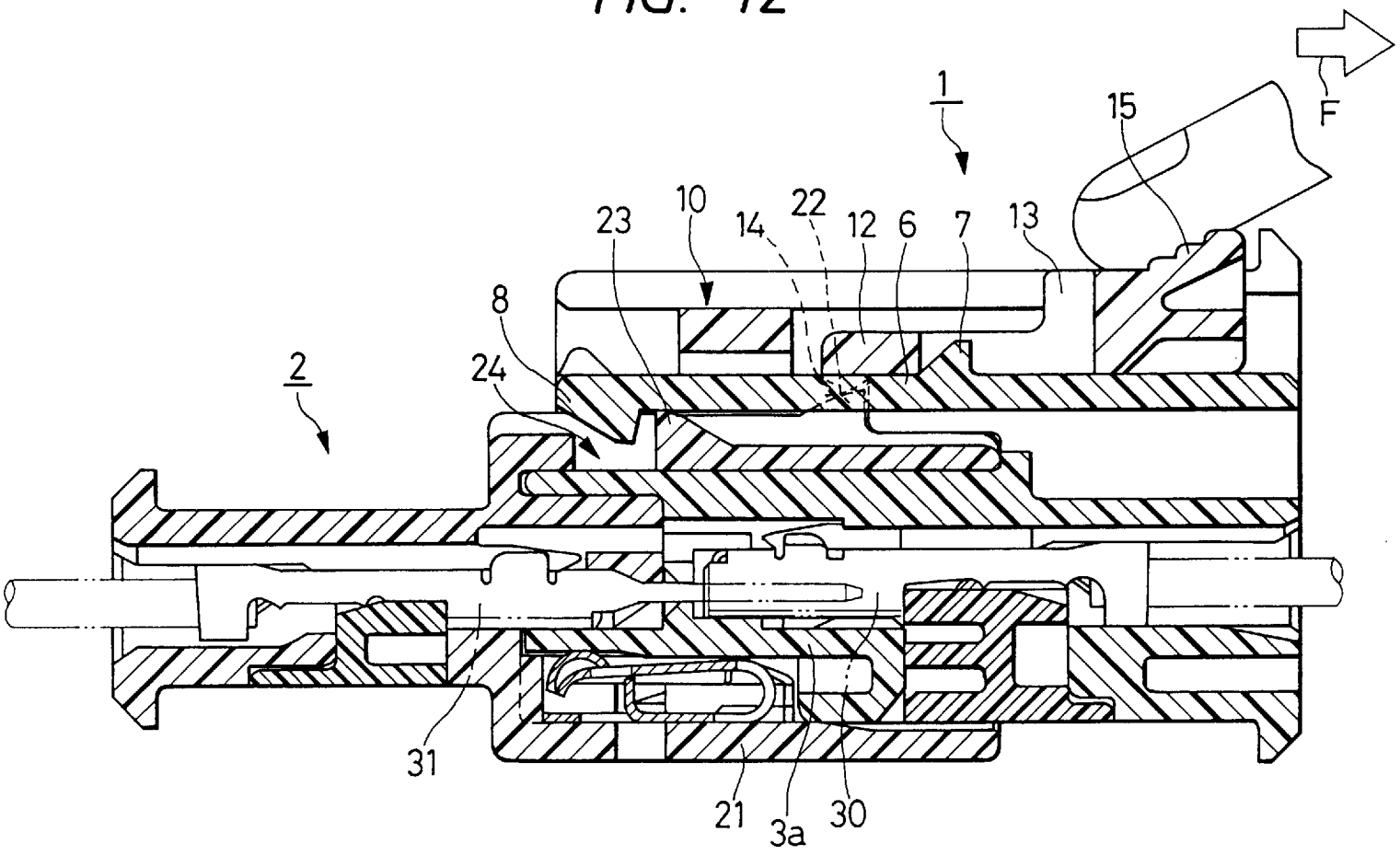
FIG. 12 is a view showing an initial fitting release condition of the male and female connectors.
Figure 13:
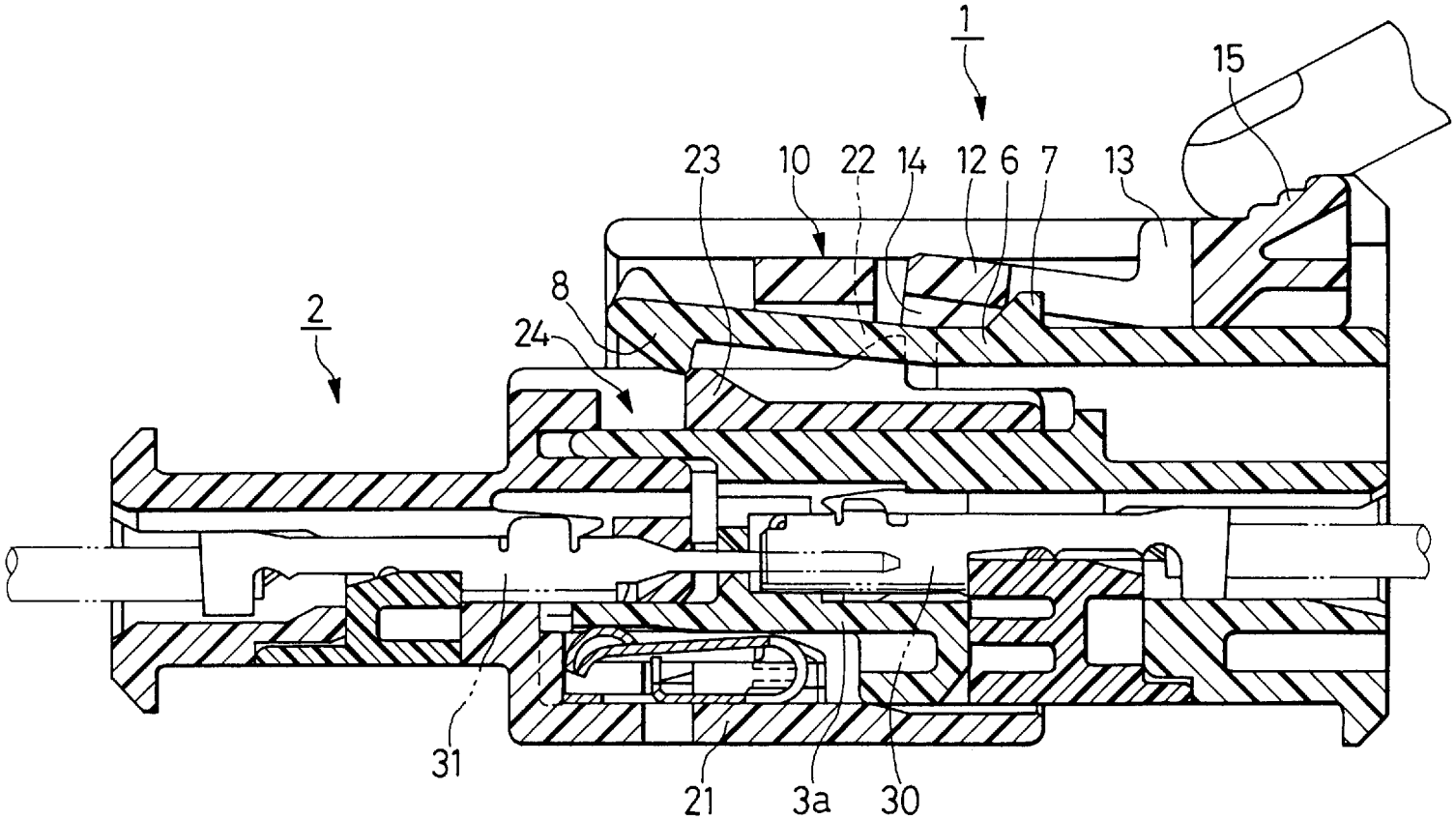
FIG. 13 is a view showing a condition during the fitting release operation of FIG. 12.
Figure 14:
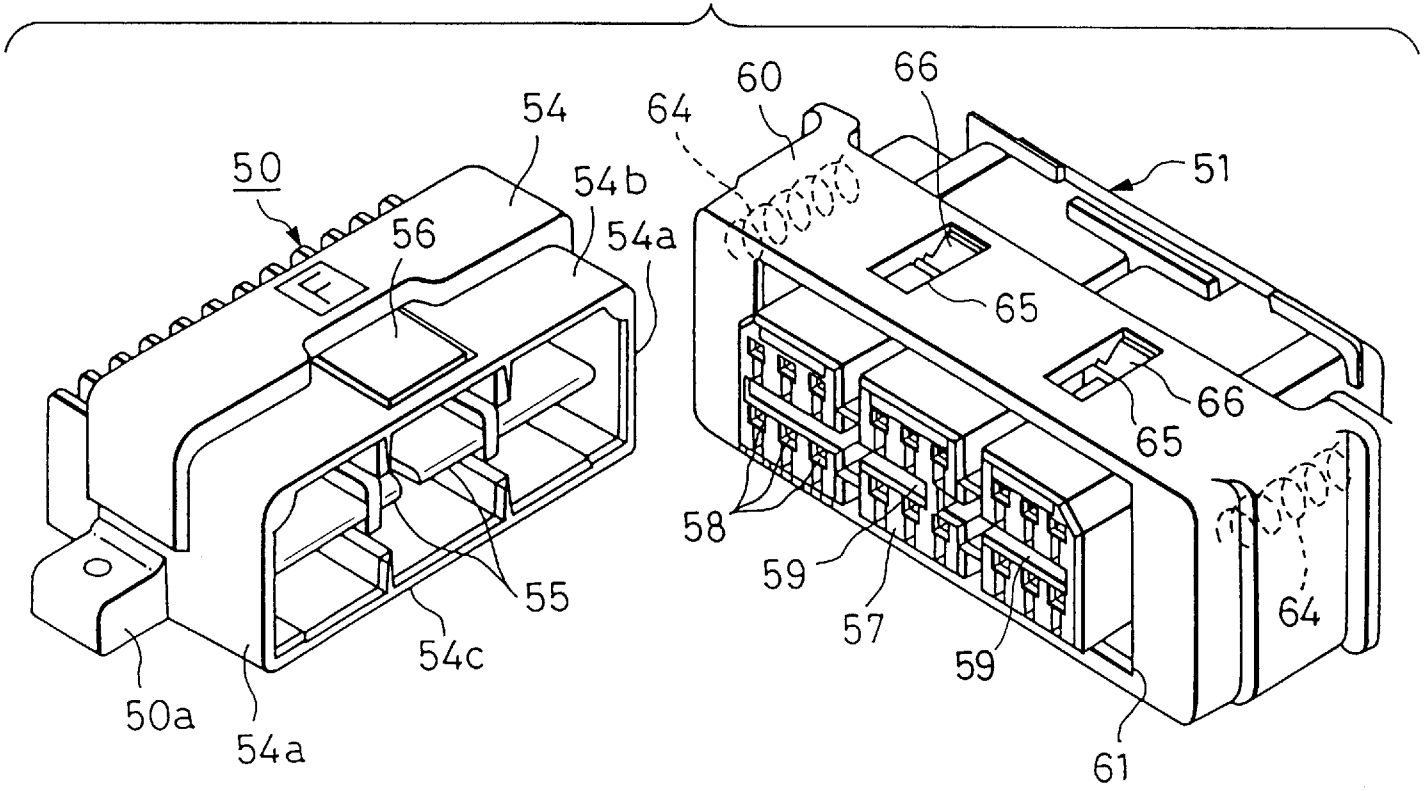
FIG. 14 PRIOR ART
FIG. 14 is a perspective view showing a conventional connector construction.
Figure 15:
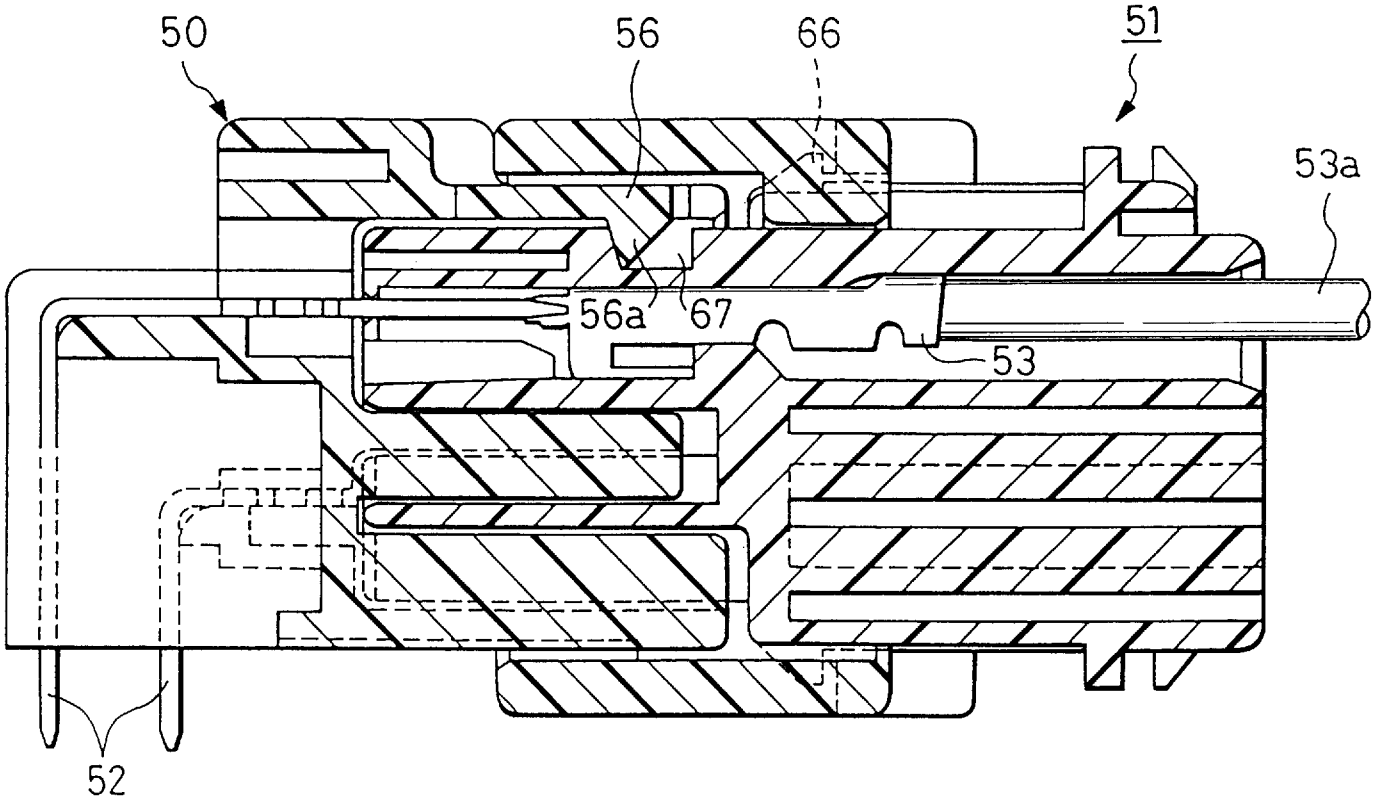
FIG. 15 PRIOR ART
FIG. 15 is a vertical cross-sectional view showing a fitted condition of connectors in FIG. 14.

As shown in FIGS. 12 and 13, for releasing the above completely-fitted condition, the male connector is withdrawn in a direction of arrow F (FIG. 12) while depressing the press portion 15 of the slider 10 by the finger, so that the slider arm 12 of the slider 10 slides over the slanting surface of the lock beak 7, and is flexed upwardly.

Then, the abutment of the displacement prevention portion 17 of the slider 10 against the displacement prevention projections 8*a* of the housing lock 8 is released, so that the free end of the housing lock 8 can be displaced. When the force, tending to disengage the two connectors from each other, is applied, the housing lock 8, retainingly engaged in the engagement groove 24, is displaced upward to be disengaged from the engagement groove 24. In this condition, the body of the female connector 2 is held with the hand, and is moved rearward, and by doing so, the female connector 2 can be easily disengaged from the male connector 1.

As described above, in the connector fitting construction of this embodiment, in the half-fitted condition, the male and female connectors 1 and 2 can be moved away from each other by the resilient force of the compression springs 9, and the fitted condition can be easily detected through the sense of touch, obtained during the fitting operation, and also through the position of the slider 10.

The male and female connectors can be fitted together while holding the side wall of the male housing 1 with the hand, and the fitting operation can be easily carried out.

Since the slider arm 12 is provided in the slider body 11, the slider 10 can be formed into a small size. And besides, the side spaces 4*a* are provided respectively on the opposite sides of the lock arm 6, and the abutment projections 14 of the slider 10 are disposed respectively in these side spaces 4*a*, and therefore at least the male housing 1, having the slider 10 mounted thereon, can be formed into a small size.

The connector fitting construction of the present invention is not limited to the above embodiment, and modifications can be made. The above embodiment is directed to the construction of fitting the-connectors of the non-waterproof type together, but the invention can be applied to a construction of fitting connectors of the waterproof type together. In the above embodiment, although the exclusive-use housing, exclusively used for receiving the slider, is provided on the male connector while the stopper projections and so on are provided on the female connector, there can be provided a connector fitting construction in which the exclusive housing is provided on a female connector, and the stopper projections and so on are provided on a male connector.

As described above, in the connector fitting construction, the receiving portion, receiving the slide lock member therein, is formed by the exclusive-use housing other than the connector housing, and the side spaces are provided in the receiving portion, and are disposed respectively on the opposite sides of the elastic member, and the abutment projections, formed respectively on the opposite side portions of the lower surface of the elastic arm formed on the slide lock member, are disposed respectively in the side spaces.

The elastic member is the lock arm of the cantilever-type having the lock beak formed on the upper surface thereof, and the lock beak has the slanting surface, and the engagement projection for being retained on the mating housing is formed on the lower surface of the lock arm at the front end thereof.

The slide lock member has the elastic arm of the cantilever type provided at the generally central portion of the body of the slide lock member, the elastic arm having the pair of abutment projections, and the slide lock member further includes the press portion which is formed on the upper surface thereof at the rear end thereof, and is operated when releasing the fitted condition, the slide groove formed in the elastic arm and the press portion, and the spring retaining portions respectively retaining the compression springs serving as the resilient member.

The guide grooves for respectively guiding the opposite side portions of the lock member body are formed respectively in the opposite side portions of the exclusive-use housing, and the spring receiving portions of a tubular shape are formed respectively at the rear ends of the guide grooves.

The mating connector includes the pair of stopper projections for abutting respectively against the abutment projections of the slide lock member when fitting the two connectors together, the slanting projection which is formed between the stopper projections, and has the slanting surface for flexing the elastic member, and the engagement groove formed adjacent to the rear end of the slanting projection for engagement with the engagement projection.

Therefore, in the half-fitted condition, the male and female connectors can be moved away from each other by the resilient force of the resilient members, and the fitted condition can be easily detected through the sense of touch, obtained during the fitting operation, and also through the position of the slide lock member.

The male and female connectors can be fitted together while holding the side wall of the male housing with the hand, and the fitting operation can be easily carried out, and therefore the efficiency of the fitting operation and the releasing operation can be enhanced.

Since the elastic arm is provided in the body of the slide lock member, the slide lock member can be formed into a small size. And besides, the side spaces are provided respectively on the opposite sides of the lock arm, and the abutment projections of the slider lock member are disposed respectively in these side spaces, and therefore the connector, having the slide lock member mounted thereon, can be formed into a small size.

What is claimed is:

1. A connector fitting construction comprising:

a first connector including a housing having a terminal receiving chamber for receiving a first terminal; and a second connector fittable to the first connector, the second connector including:

a housing including a first portion having a terminal receiving chamber for receiving a second terminal matable with the first terminal, and a second portion having a lock arm and side spaces disposed respectively on opposite sides of said lock arm;

a spring member mounted in the second portion, wherein a half-fitted condition of the two connectors is prevented by a spring force of said spring member; and a slide lock member which is slidably supported in the second portion, and cooperates with said spring member so that said lock arm retains the housing of the first connector when the first and second connectors are fitted to each other, the slide lock member including an elastic arm having abutment projections formed respectively on opposite side portions of a lower surface of the elastic arm, the abutment projections which can be disposed respectively in the side spaces of the second portion.

2. The connector fitting construction of claim 1, wherein said lock arm is formed in a cantilever shape.

3. The connector fitting construction of claim 2, wherein the lock arm has a lock beak formed on an upper surface thereof, the lock beak has a slanting surface, and an engagement projection can be retained on the housing of the first connector, the engagement projection is formed on a lower surface of the lock arm at a front end thereof.

4. The connector fitting construction of claim 1, wherein the elastic arm is formed in the cantilever shape, and is provided at a generally central portion of a body of the slide lock member.

5. The connector fitting construction of claim 1, wherein the slide lock member further includes a press portion which is formed on an upper surface thereof at a rear end thereof and a slide groove formed in the elastic arm and the press portion.

6. The connector fitting construction of claim 5, wherein said spring member includes a pair of springs, and wherein the slide lock member further includes retaining portions which are formed respectively at opposite side portions of the rear end thereof, and respectively retain the springs.

7. The connector fitting construction of claim 6, wherein the second portion has guide grooves, for respectively guiding the opposite side portions of the slide lock member, which are formed respectively in opposite side within the second portion, and spring receiving portions of a tubular shape, for receiving the springs, are formed respectively at rear ends of the guide grooves.

8. The connector fitting construction of claim 3, wherein the housing of the first connector includes a pair of stopper projections abuttable respectively against the abutment projections of the slide lock member, when fitting the two connectors together, a slanting projection which is formed between the stopper projections, and has a slanting surface for flexing the elastic member, and an engagement groove formed adjacent to a rear end of the slanting projection for engagement with the engagement projection.

* * * * *